US011927064B2

(12) United States Patent
Pendse et al.

(10) Patent No.: US 11,927,064 B2
(45) Date of Patent: Mar. 12, 2024

(54) UNIFIED SETTING TOOL AND WIRELINE ADAPTER KIT

(71) Applicant: Schlumberger Technology Corporation, Sugar Land, TX (US)

(72) Inventors: Bhushan Pendse, Houston, TX (US); Laurent Alteirac, Missouri City, TX (US); Robert M. Graham, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 268 days.

(21) Appl. No.: 17/447,578

(22) Filed: Sep. 14, 2021

(65) Prior Publication Data

US 2022/0081985 A1 Mar. 17, 2022

Related U.S. Application Data

(60) Provisional application No. 63/077,767, filed on Sep. 14, 2020.

(51) Int. Cl.
*E21B 23/04* (2006.01)
*E21B 23/14* (2006.01)

(52) U.S. Cl.
CPC ..... *E21B 23/0414* (2020.05); *E21B 23/14* (2013.01)

(58) Field of Classification Search
CPC ..... E21B 23/0414; E21B 23/14
See application file for complete search history.

(56) References Cited

U.S. PATENT DOCUMENTS

| | | | | |
|---|---|---|---|---|
| 3,002,559 | A | 10/1961 | Hanes | |
| 3,387,659 | A | 6/1968 | Current | |
| 9,810,035 | B1 | 11/2017 | Carr et al. | |
| 10,927,627 | B2 * | 2/2021 | Eitschberger | E21B 23/0412 |
| 10,934,794 | B2 | 3/2021 | Knight et al. | |
| 10,934,795 | B2 * | 3/2021 | Wells | E21B 23/065 |
| 11,047,188 | B2 * | 6/2021 | Wells | E21B 23/08 |
| 11,066,886 | B2 | 7/2021 | Mickey | |

(Continued)

OTHER PUBLICATIONS

Notice of Allowance issued in U.S. Appl. No. 16/599,381 dated Apr. 12, 2022, 12 pages.

(Continued)

*Primary Examiner* — Nicole Coy
(74) *Attorney, Agent, or Firm* — Michael Wills, III

(57) ABSTRACT

A system includes a setting tool, which includes a housing, a piston, and an inner mandrel, and a settable device. The housing includes a first section configured as a setting sleeve, an intermediate section, and a second section. The piston includes an interior power charge chamber and a piston housing including at least one passage in fluid communication with the power charge chamber that interfaces with a top face of the intermediate section of the housing. The piston is mounted within a second bore of the second section via an anti-present mechanism. The inner mandrel is received in the second bore within a bottom recess of the piston housing and extends longitudinally through bores of the intermediate and first sections. At least a portion of the system is adjustable to eliminate a gap between the setting sleeve and a top of the settable device mounted on the inner mandrel.

17 Claims, 2 Drawing Sheets

(56) References Cited

U.S. PATENT DOCUMENTS

| | | | | |
|---|---|---|---|---|
| 11,255,147 | B2 * | 2/2022 | Eitschberger | E21B 23/042 |
| 11,280,143 | B2 * | 3/2022 | Robicheaux | E21B 23/0414 |
| 11,401,761 | B2 * | 8/2022 | Flores Perez | E21B 33/128 |
| 11,578,549 | B2 * | 2/2023 | Eitschberger | E21B 23/0417 |
| 2007/0151722 | A1 | 7/2007 | Lehr et al. | |
| 2019/0277103 | A1 * | 9/2019 | Wells | E21B 33/128 |
| 2020/0095838 | A1 * | 3/2020 | Baker | E21B 23/04 |
| 2020/0115977 | A1 | 4/2020 | Norrid et al. | |
| 2022/0127919 | A1 * | 4/2022 | Gleason | E21B 23/04 |

OTHER PUBLICATIONS

Action issued in the related U.S. Appl. No. 16/599,381, dated Nov. 5, 2021 (8 pages).
Office Action issued in the related U.S. Appl. No. 16/599,381, dated Jan. 28, 2022, 9 pages.

* cited by examiner

UNIFIED SETTING TOOL AND WIRELINE ADAPTER KIT

CROSS REFERENCE TO RELATED APPLICATIONS

The present application claims priority benefit of U.S. Provisional Application No. 63/077,767, filed Sep. 14, 2020, the entirety of which is incorporated by reference herein and should be considered part of this specification.

BACKGROUND

In many hydrocarbon well applications, various types of tools may be delivered downhole and set in a wellbore. For example, frac plugs or other types of sealing devices may be delivered downhole via wireline and set against a surrounding wellbore surface. The setting may be accomplished by a wireline adapter kit coupled with a wireline setting tool. A firing head, coupled with the wireline, is used to actuate an explosive which drives the setting tool so as to set the sealing device, e.g. plug, in the wellbore via the wireline adapter kit. However, the combination of the wireline adapter kit and the separate setting tool may introduce complexity and cause inconsistent setting of the sealing device. Accordingly, there is a need to streamline the setting tool and improve the setting of sealing devices in a wellbore.

SUMMARY

According to one or more embodiments of the present disclosure, a system to facilitate actuation in a borehole includes: a setting tool including: a housing including: a first section having a first bore therethrough; an intermediate section having an intermediate bore therethrough; and a second section having a second bore therethrough, wherein the first, intermediate, and second sections of the housing are integrated into a single piece, and wherein the first section is configured as a setting sleeve; a piston including: a piston housing; and an interior power charge chamber, wherein the piston housing comprises at least one passage in fluid communication with the power charge chamber that interfaces with a top face of the intermediate section of the housing, and wherein the piston is mounted within the second bore via an anti-preset mechanism affixed between the second section of the housing and an outer surface of the piston housing; and an inner mandrel slidably received in the second bore within a bottom recess of the piston housing, the inner mandrel extending longitudinally through the intermediate bore and the first bore, wherein a stem of the inner mandrel extends beyond the first bore; and a settable device mounted on the stem of the inner mandrel, wherein at least a portion of the inner mandrel is adjustable via a spring element to eliminate a gap between the setting sleeve and a top of the settable device mounted on the stem of the inner mandrel.

According to one or more embodiments of the present disclosure, a system to facilitate actuation in a borehole includes a setting tool including: a housing; and an inner mandrel fixed to the housing; a settable device mounted on a stem of the inner mandrel; and at least one spacer disposed on the inner mandrel that adjusts for a gap between the housing and the settable device.

According to one or more embodiments of the present disclosure, a system to facilitate actuation in a borehole includes a setting tool including: a housing including: a first piece including: a first section having a first bore therethrough; an intermediate section having an intermediate bore therethrough; and a second section having a second bore therethrough; and a second piece comprising a gauge ring positioned over and affixed to the first section of the first piece of the housing, a piston including: a piston housing; and an interior power charge chamber, wherein the piston housing comprises at least one passage in fluid communication with the power charge chamber that interfaces with a top face of the intermediate section of the housing, and wherein the piston is mounted within the second bore via an anti-preset mechanism affixed between the second section of the housing and an outer surface of the piston housing; and an inner mandrel received in the second bore within a bottom recess of the piston housing, the inner mandrel extending longitudinally through the intermediate bore and the first bore, wherein a stem of the inner mandrel extends beyond the first bore; and a settable device mounted on the stem of the inner mandrel, wherein the gauge ring is adjustable to eliminate a gap between the gauge ring and a top of the settable deice mounted on the stem of the inner mandrel.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to systems and methods that facilitate improved setting of downhole devices. Examples of such downhole devices include frac plugs, other types of plugs, packers, or other devices which may be deployed via wireline and set downhole. The technique according to one or more embodiments of the present disclosure utilizes a unified setting tool and wireline adapter kit to provide a compact disposable solution for effectively setting downhole devices.

Figure 1:
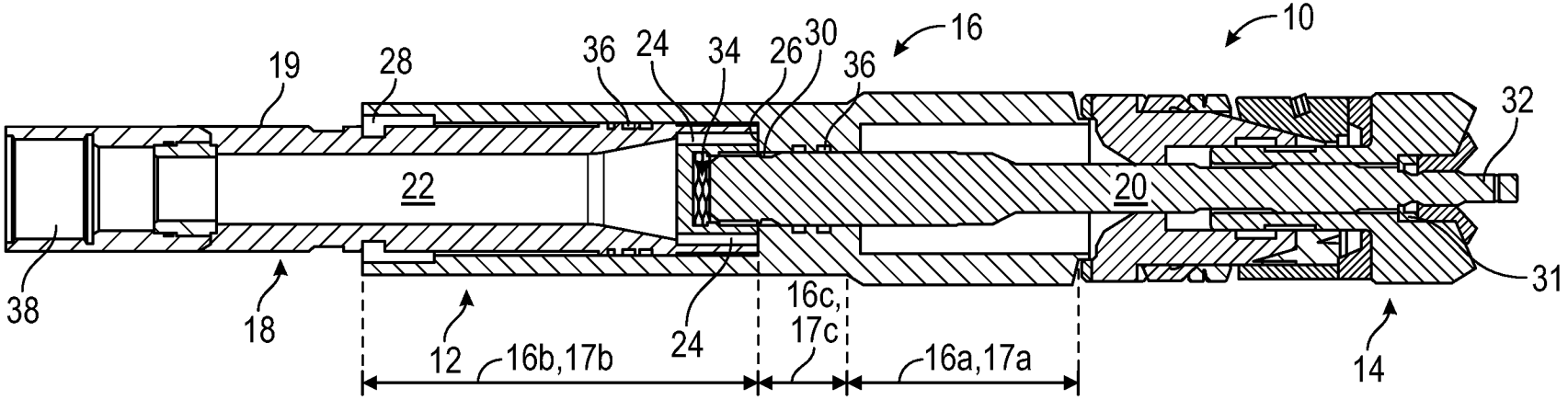
FIG. 1 is a cross-sectional view of a settable device, e.g., a plug, coupled with a unified setting tool and wireline adapter kit having an adjustable inner mandrel, according to one or more embodiments of the present disclosure.

Referring now to FIG. 1, a cross-sectional view of a settable device, e.g., a plug coupled with a unified setting tool and wireline adapter kit having an adjustable inner mandrel, according to one or more embodiments of the present disclosure is shown. As shown in FIG. 1, the system 10 according to one or more embodiments of the present disclosure includes a setting tool 12 and a settable device 14. Although FIG. 1 shows that the settable device 14 may be a plug, the settable device 14 may also be a packer, or other device that may be deployed via wireline and set downhole, for example.

Still referring to FIG. 1, the setting tool 12 may include a housing 16, a piston 18, and an inner mandrel 20, according to one or more embodiments of the present disclosure. As shown in FIG. 1, the housing 16 of the setting tool 12 may include a first section 16*a*, a second section 16*b*, and an intermediate section 16*c* between the first section 16*a* and the second section 16*b*. Further, the first section 16*a* may include a first bore 17*a* therethrough, the second section 16*b* may include a second bore 17*b* therethrough, and the intermediate section 16*c* may include an intermediate bore 17*c* therethrough. According to one or more embodiments of the present disclosure, the first section 16*a*, the second section 16*b*, and the intermediate section 16*c* of the housing 16 are integrated into a single piece. Further, the first section 16*a* of the housing 16 may be configured as a setting sleeve to facilitate setting of the settable device 14 in accordance with one or more embodiments of the present disclosure.

Still referring to FIG. 1, the piston 18 of the setting tool 12 may include a piston housing 19, and an interior power charge chamber 22 according to one or more embodiments of the present disclosure. Further, the piston housing 19 of the piston 18 may include at least one passage 24 in fluid communication with the power charge chamber 22 that interfaces with a top face 26 of the intermediate section 16*c* of the housing 16 of the setting tool 12, in accordance with one or more embodiments of the present disclosure. As further shown in FIG. 1, the piston 18 may be mounted within the second bore 17*b* of the second section 16*b* of the housing 16 via an anti-preset mechanism 28 affixed between the second section 16*b* of the housing 16 and an outer surface of the piston housing 19. In one or more embodiments of the present disclosure, the anti-preset mechanism 28 may be a shear screw or a shear pin, for example. As also shown in FIG. 1, at least one seal 36 may be disposed between the outer surface of the piston housing 19 and the housing 16 of the setting tool 12.

Still referring to FIG. 1, the inner mandrel 20 of the setting tool 12 may be slidably received in the second bore 17*b* within a bottom recess 30 of the piston housing 19, and the inner mandrel 20 may extend longitudinally through the intermediate bore 17*c* of the intermediate section 16*c* and the first bore 17*a* of the first section 16*a* of the housing 16. As further shown in FIG. 1, at least one seal 36 may be disposed between the inner mandrel 20 and the intermediate section 16*c* of the housing 16, according to one or more embodiments of the present disclosure. As further shown in FIG. 1, a stem 32 of the inner mandrel 20 may extend beyond the first bore 17*a* of the first section 16*a* of the housing, in one or more embodiments of the present disclosure, which allows the settable device 14 to be mounted on the stem 32 of the inner mandrel 20. According to one or more embodiments of the present disclosure, the settable device 14 may be mounted on the stem 32 of the inner mandrel 20 with a fastener 31, such as a nut, for example. In one or more embodiments of the present disclosure, the inner mandrel 20 may be a tension mandrel, for example. According to one or more embodiments of the present disclosure, at least a portion of the inner mandrel 20 is adjustable via a spring element 34 to eliminate a gap between the setting sleeve of the first section 16*a* and a top of the settable device 14 when the settable device 14 is mounted on the stem 32 of the inner mandrel 20. According to one or more embodiments of the present disclosure, the spring element 34 may be a weak coil, or a wave spring, for example. As shown in FIG. 1, the spring element 34 may be disposed within the bottom recess 30 of the piston housing 19 such that the spring element 34 contacts a top end of the inner mandrel 20, according to one or more embodiments of the present disclosure.

Still referring to FIG. 1, the setting tool 12 according to one or more embodiments of the present disclosure may also include a firing head adapter 38 connected to the piston 18 for receiving a firing head, which may ignite a setting charge disposed in the power charge chamber 22. In one or more embodiments of the present disclosure, burning of the setting charge releases pressurized gas into the power charge chamber 22, and the pressurized gas may flow into the at least one passage 24 in the piston housing 19. As the pressurized gas fills the at least one passage 24 in the piston housing 19, the force of the pressurized gas presses against the top face 26 of the intermediate section 16*c* of the housing 16 until the force is strong enough to overcome the anti-preset mechanism 28. Once the anti-preset mechanism 28 shears, breaks, or bursts, the setting tool 12 moves downward, causing the setting sleeve of the first section 16*a* to push on the top of the settable device 14, which sets the settable device 14.

Figure 2:
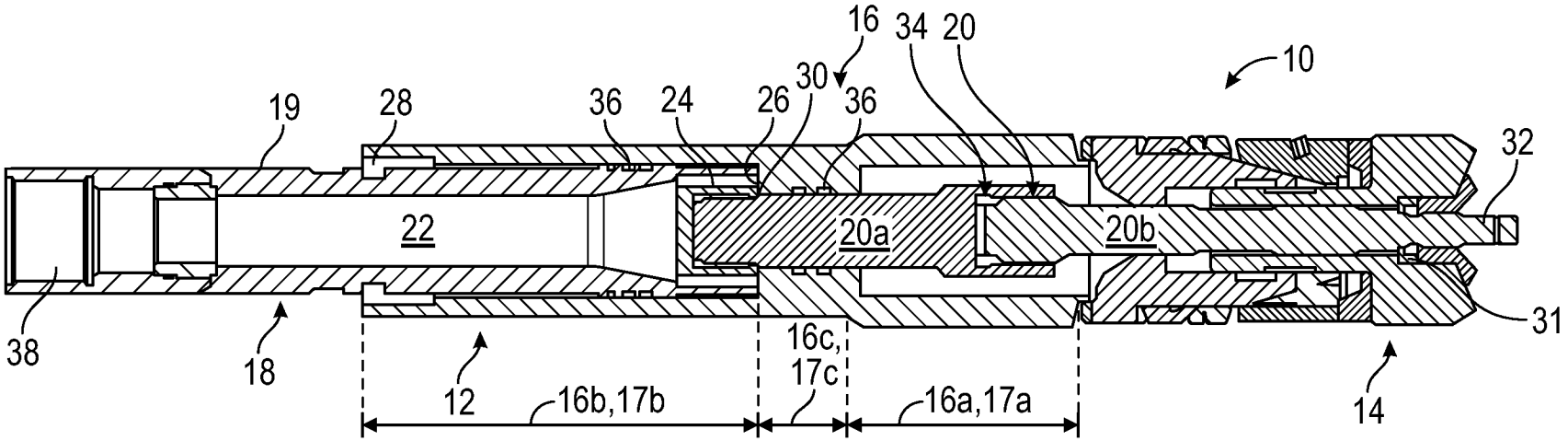
FIG. 2 is a cross-sectional view of a settable device, e.g., a plug, coupled with a unified setting tool and wireline adapter kit having a two piece inner mandrel, according to one or more embodiments of the present disclosure.

Referring now to FIG. 2, a cross-sectional view of a settable device, e.g., a plug, coupled with a unified setting tool and wireline adapter kit having an adjustable two piece inner mandrel, according to one or more embodiments of the present disclosure is shown. For the sake of clarity, only the differences between the system 10 shown in FIG. 2 and the system 10 shown in FIG. 1 will be described here. As shown in FIG. 2, the inner mandrel 20 according to one or more embodiments of the present disclosure may include a fixed portion 20*a* and an adjustable portion 20*b*, and the stem 32 of the inner mandrel 20 is included in the adjustable portion 20*b*. In such embodiments of the present disclosure, the spring element 34 may be disposed between the fixed portion 20*a* and the adjustable portion 20*b* of the inner mandrel 20. Due to the adjustability of the adjustable portion 20*b* of the inner mandrel 20 via the spring element 34, the system 10 may be assembled in such a way as to eliminate any gap between the setting sleeve of the first section 16*a* and a top of the settable device 14 when the settable device 14 is mounted on the stem 32 of the inner mandrel 20 in one or more embodiments of the present disclosure.

Figure 3:
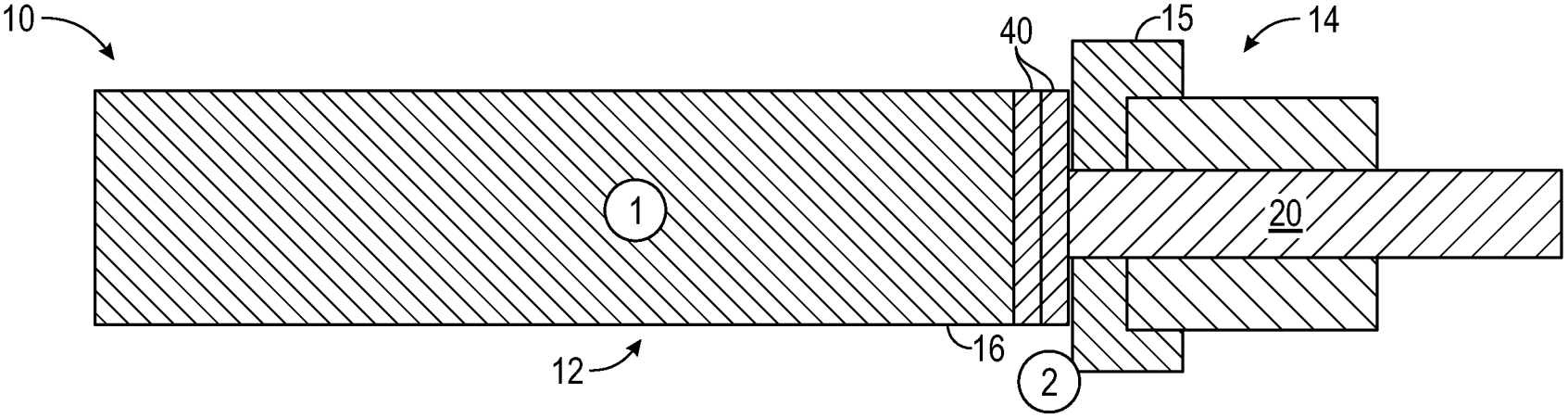
FIG. 3 is a simplified illustration of a settable device, e.g., a plug, mounted on an inner mandrel, according to one or more embodiments of the present disclosure.

Referring now to FIG. 3, a simplified illustration of a settable device, e.g., a plug, mounted on an inner mandrel, according to one or more embodiments of the present disclosure is shown. As shown in FIG. 3, the system 10 includes a setting tool 12 including a housing 16 and an inner mandrel 20 fixed to the housing 16. According to one or more embodiments of the present disclosure, the inner mandrel 20 may be a tension mandrel, for example. As further shown in FIG. 3, a settable device 14, which may be a plug, a packer, or any other device that may be deployed via wireline and set downhole, is mounted on a stem 32 of the inner mandrel 20. In one or more embodiments of the present disclosure, the settable device 14 may include a ring 15, such as a brass ring, for example, disposed at a top of the settable device 14. The system 10 according to one or more embodiments of the present disclosure may also include at least one spacer 40 on the inner mandrel 20 that adjusts for a gap between the housing 16 and the settable device 14.

Figure 4:
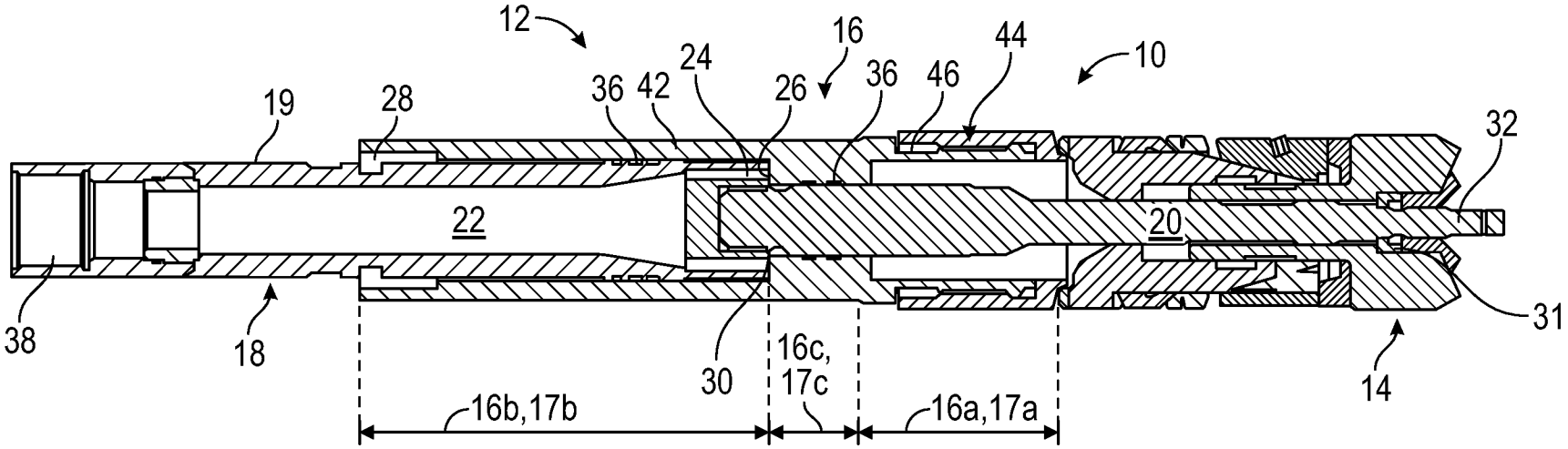
FIG. 4 is a cross-sectional view of a settable device, e.g., a plug, coupled with a unified setting tool and wireline adapter kit having a two piece housing, according to one or more embodiments of the present disclosure.

Referring now to FIG. 4, a cross-sectional view of a settable device, e.g., a plug, coupled with a unified setting tool and wireline adapter kit having a two piece housing, according to one or more embodiments of the present disclosure is shown. As shown in FIG. 4, the system 10 according to one or more embodiments of the present disclosure includes a setting tool 12 and a settable device 14. Although FIG. 4 shows that the settable device 14 may be a plug, the settable device 14 may also be a packer, or other device that may be deployed via wireline and set downhole, for example.

Still referring to FIG. 4, the setting tool 12 may include a housing 16 including a first piece 42 and a second piece 44. That is, the system 10 according to one or more embodiments of the present disclosure includes a setting tool 12 having a two piece housing 16. In one or more embodiments of the present disclosure, the first piece 42 of the two piece housing 16 includes a first section 16*a*, a second section 16*b*, and an intermediate section 16*c* between the first section 16*a* and the second section 16*b*. Further, the first section 16*a* may include a first bore 17*a* therethrough, the second section 16*b* may include a second bore 17*b* therethrough, and the intermediate section 16*c* may include an intermediate bore 17*c* therethrough. According to one or more embodiments of the present disclosure, the first section 16*a*, the second section 16*b*, and the intermediate section 16*c* of the housing 16 are integrated into the first piece 42. As also shown in FIG. 4, the second piece 44 of the housing 16 includes a gauge ring positioned over the first section 16*a* of the first piece 42 of the housing 16 and affixed thereto. According to one or more embodiments of the present disclosure, the gauge ring 44 is adjustable and may be affixed to the first section 16*a* via at least one fastener 46, such as a set screw, for example. In one or more embodiments of the present disclosure, the gauge ring 44 facilitates setting of the settable device 14, as further described below. Moreover, due to the adjustability of the gauge ring 44, the system 10 may be assembled in such a way as to eliminate any gap between the gauge ring 44 of the second piece of the housing 16 and a top of the settable device 14 when the settable device 14 is mounted on the stem 32 of the inner mandrel 20 in one or more embodiments of the present disclosure.

Still referring to FIG. 4, the piston 18 of the setting tool 12 may include a piston housing 19, and an interior power charge chamber 22 according to one or more embodiments of the present disclosure. Further, the piston housing 19 of the piston 18 may include at least one passage 24 in fluid communication with the power charge chamber 22 that interfaces with a top face 26 of the intermediate section 16*c* of the housing 16 of the setting tool 12, in accordance with one or more embodiments of the present disclosure. As further shown in FIG. 4, the piston 18 may be mounted within the second bore 17*b* of the second section 16*b* of the housing 16 via an anti-preset mechanism 28 affixed between the second section 16*b* of the housing 16 and an outer surface of the piston housing 19. In one or more embodiments of the present disclosure, the anti-preset mechanism 28 may be a shear screw or a shear pin, for example. As also shown in FIG. 4, at least one seal 36 may be disposed between the outer surface of the piston housing 19 and the housing 16 of the setting tool 12.

Still referring to FIG. 4, the inner mandrel 20 of the setting tool 12 may be received in the second bore 17*b* within a bottom recess 30 of the piston housing 19, and the inner mandrel 20 may extend longitudinally through the intermediate bore 17*c* of the intermediate section 16*c* and the first bore 17*a* of the first section 16*a* of the housing 16. As further shown in FIG. 4, at least one seal 36 may be disposed between the inner mandrel 20 and the intermediate section 16*c* of the housing 16, according to one or more embodiments of the present disclosure. As further shown in FIG. 4, a stem 32 of the inner mandrel 20 may extend beyond the first bore 17*a* of the first section 16*a* of the housing, in one or more embodiments of the present disclosure, which allows the settable device 14 to be mounted on the stem 32 of the inner mandrel 20. According to one or more embodiments of the present disclosure, the settable device 14 may be mounted on the stem 32 of the inner mandrel 20 with a fastener 31, such as a nut, for example. In one or more embodiments of the present disclosure, the inner mandrel 20 may be a tension mandrel, for example. According to one or more embodiments of the present disclosure, the inner mandrel 20 is fixed within the bottom recess 30 of the piston housing 19 and along its longitudinal length.

Still referring to FIG. 4, the setting tool 12 according to one or more embodiments of the present disclosure may also include a firing head adapter 38 connected to the piston 18 for receiving a firing head, which may ignite a setting charge disposed in the power charge chamber 22. In one or more embodiments of the present disclosure, burning of the setting charge releases pressurized gas into the power charge chamber 22, and the pressurized gas may flow into the at least one passage 24 in the piston housing 19. As the pressurized gas fills the at least one passage 24 in the piston housing 19, the force of the pressurized gas presses against the top face 26 of the intermediate section 16*c* of the housing 16 until the force is strong enough to overcome the anti-preset mechanism 28. Once the anti-preset mechanism 28 shears, breaks, or bursts, the setting tool 12 moves downward, causing the gauge ring 44 of the second piece of the housing 16 to push on top of the settable device 14, which sets the settable device 14.

As previously described, the unified setting tool and wireline adapter kit according to one or more embodiments of the present disclosure is adjustable, either via the inner mandrel 20, at least one spacer 40, or a gauge ring 44 as part of a two piece housing 16, in order to eliminate any gap between the setting tool 12 and the settable device 14 during assembly and before the system 10 is deployed into the borehole. Advantageously, these adjustable configurations of the unified setting tool and wireline adapter kit prevent unwanted debris from entering the system 10 between the setting tool 12 and the settable device 14 while running in hole, ensure consistent contact between the setting tool 12 and the settable device 14, and prevent inconsistent setting of the settable device 14 by the setting tool 12.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system to facilitate actuation in a borehole, comprising:

a setting tool comprising:

a housing comprising:
a first section having a first bore therethrough;
an intermediate section having an intermediate bore therethrough; and
a second section having a second bore therethrough,
wherein the first, intermediate, and second sections of the housing are integrated into a single piece, and
wherein the first section is configured as a setting sleeve;
a piston comprising:
a piston housing; and
an interior power charge chamber,
wherein the piston housing comprises at least one passage in fluid communication with the power charge chamber that interfaces with a top face of the intermediate section of the housing, and
wherein the piston is mounted within the second bore via an anti-preset mechanism affixed between the second section of the housing and an outer surface of the piston housing; and
an inner mandrel slidably received in the second bore within a bottom recess of the piston housing, the inner mandrel extending longitudinally through the intermediate bore and the first bore,
wherein a stem of the inner mandrel extends beyond the first bore; and
a settable device mounted on the stem of the inner mandrel,
wherein at least a portion of the inner mandrel is adjustable via a spring element to eliminate a gap between the setting sleeve and a top of the settable device mounted on the stem of the inner mandrel.

2. The system of claim 1, wherein the spring element is disposed within the bottom recess of the piston housing such that the spring element contacts a top end of the inner mandrel.

3. The system of claim 1,
wherein the inner mandrel comprises a fixed portion and an adjustable portion,
wherein the stem of the inner mandrel is included in the adjustable portion, and
wherein the spring element is disposed between the fixed portion and the adjustable portion of the inner mandrel.

4. The system of claim 1, further comprising a firing head adapter connected to the piston for receiving a firing head.

5. The system of claim 1, wherein the inner mandrel is a tension mandrel.

6. The system of claim 1,
wherein pressurized gas resulting from an ignited setting charge disposed in the power charge chamber enters the at least one passage, and
wherein force from the pressurized gas presses against the top face of the intermediate section of the housing, overcoming the anti-preset mechanism and moving the setting tool downward, which causes the setting sleeve to push on the top of the settable device, thereby setting the settable device.

7. The system of claim 6, wherein the anti-preset mechanism is a shear screw.

8. The system of claim 1, wherein at least one seal is disposed between the outer surface of the piston housing and the housing of the setting tool.

9. The system of claim 1, wherein at least one seal is disposed between the inner mandrel and the intermediate section of the housing.

10. A system to facilitate actuation in a borehole, comprising:
a setting tool comprising:
a housing comprising:
a first piece comprising:
a first section having a first bore therethrough;
an intermediate section having an intermediate bore therethrough; and
a second section having a second bore therethrough; and
a second piece comprising a gauge ring positioned over and affixed to the first section of the first piece of the housing,
a piston comprising:
a piston housing; and
an interior power charge chamber,
wherein the piston housing comprises at least one passage in fluid communication with the power charge chamber that interfaces with a top face of the intermediate section of the housing, and
wherein the piston is mounted within the second bore via an anti-preset mechanism affixed between the second section of the housing and an outer surface of the piston housing; and
an inner mandrel received in the second bore within a bottom recess of the piston housing, the inner mandrel extending longitudinally through the intermediate bore and the first bore,
wherein a stem of the inner mandrel extends beyond the first bore; and
a settable device mounted on the stem of the inner mandrel,
wherein the gauge ring is adjustable to eliminate a gap between the gauge ring and a top of the settable device mounted on the stem of the inner mandrel.

11. The system of claim 10, wherein the inner mandrel is fixed.

12. The system of claim 10, wherein the inner mandrel is a tension mandrel.

13. The system of claim 10, further comprising a firing head adapter connected to the piston for receiving a firing head.

14. The system of claim 10,
wherein pressurized gas resulting from an ignited setting charge disposed in the power charge chamber enters the at least one passage, and
wherein force from the pressurized gas presses against the top face of the intermediate section of the housing, overcoming the anti-preset mechanism and moving the setting tool downward, which causes the gauge ring to push on the top of the settable device, thereby setting the settable device.

15. The system of claim 14, wherein the anti-preset mechanism is a shear screw.

16. The system of claim 10, wherein at least one seal is disposed between the outer surface of the piston housing and the housing of the setting tool.

17. The system of claim 10, wherein at least one seal is disposed between the inner mandrel and the intermediate section of the housing.

* * * * *